US005188525A

United States Patent [19]

Porter

[11] Patent Number: 5,188,525

[45] Date of Patent: Feb. 23, 1993

[54] FUEL CONVERTER FOR GASOLINE POWERED LANTERNS

[75] Inventor: Marvin Porter, San Antonio, Tex.

[73] Assignee: Texas Trunk Company, Inc., San Antonio, Tex.

[21] Appl. No.: 816,769

[22] Filed: Jan. 2, 1992

[51] Int. Cl.[5] ..... F21H 1/00

[52] U.S. Cl. ..... 431/107

[58] Field of Search ..... 431/103-107, 431/207; 165/183, 76

[56] References Cited

U.S. PATENT DOCUMENTS

| | | | |
|---|---|---|---|
| 608,051 | 7/1898 | Kitson | 431/107 |
| 613,419 | 11/1898 | Kidd | 431/107 |
| 676,522 | 6/1901 | Woillard | 431/107 |
| 930,020 | 8/1909 | Arneson | 431/107 |
| 976,127 | 11/1910 | Harding | 431/107 |
| 1,042,863 | 10/1912 | Wiltermood | 431/107 |
| 1,340,424 | 5/1920 | Stafford | 431/107 |
| 1,678,828 | 7/1928 | Schultz | 431/107 |
| 1,910,163 | 5/1933 | Hogan | 431/107 |
| 2,263,659 | 11/1941 | Tullis | 431/107 |
| 2,756,579 | 7/1956 | Graetz | 431/107 |
| 3,031,171 | 4/1962 | Buttner | 165/183 |

FOREIGN PATENT DOCUMENTS

| | | | |
|---|---|---|---|
| 665785 | 10/1938 | Fed. Rep. of Germany | 431/107 |
| 2318180 | 10/1974 | Fed. Rep. of Germany | 165/183 |
| 28994 | 2/1982 | Japan | 165/183 |
| 56812 | 8/1944 | Netherlands | 431/107 |

*Primary Examiner*—James C. Yeung

*Attorney, Agent, or Firm*—Cox & Smith Incorporated

[57] ABSTRACT

A fuel converter which will allow the use of regular unleaded gasoline in camping lanterns that heretofore could only use "white" gasoline to facilitate the clean burning of regular non-leaded gasoline in the camping lantern.

1 Claim, 2 Drawing Sheets

FUEL CONVERTER FOR GASOLINE POWERED LANTERNS

BACKGROUND OF THE INVENTION

Field of the Invention

The present invention relates to an apparatus that allows a portable camping lantern to use regular unleaded gasoline as a fuel.

Background Description

The present invention relates to portable camping lanterns and has particular reference to Coleman brand lanterns that preferably use a specially blended "white" gasoline to provide fuel for lighting. "White" gasoline is said to burn clean and has a consistent boiling point. These particular types of lanterns employ mantels which are heated to incandescence by burning the "white" gasoline. The fuel is placed under pressure in the reservoir of the lantern. When a valve is opened, fuel flows through a valve into a vertical generator where the flow is restricted by an orifice. The fuel passing through the orifice vaporizes into small particles. The vaporized fuel then proceeds to an expansion chamber where the vaporized fuel is mixed with sufficient air to form a more volatile mixture to be burned in the mantel.

A principal drawback to using lanterns that require "white" gasoline as a fuel is the high cost of that fuel as compared to regular unleaded gasoline. If regular unleaded gasoline is used as an alternative fuel, the fuel generator typically clogs with residue in the unvaporized gasoline. The orifice of the fuel generator will also typically clog. Once the orifice of the generator has clogged, no vaporized gasoline passes through to be burned in the mantel. Hence, the generator must be replaced for continued use of the lantern.

In the past, individuals who desired a cheaper form of lantern fuel could only resort to regular unleaded gasoline. However, in a short period of time they found that the fuel generator of their lantern required replacement due to clogging of the orifice. The principal object of the present invention is to provide a means whereby a lantern designed to use "white" gasoline can now be used with regular unleaded gasoline without the normally attendant clogging problem discussed above. The present invention includes the addition of a fuel converter to the fuel generator.

Others have suggested various heat conducting devices, but none have suggested the device of the present invention. For example, U.S. Pat. No. 613,419, to Kidd discloses a carborating-lamp, consisting in part of a single heat conducting device in the form of a lateral projecting plate having a close fitting collar, surrounding and in contact with the fuel generator. One of the primary purposes for this heat exchanger device is to provide a simplified and less expensive means to heat natural gas in a 19th century lamp. The orifice clogging problem due to undesired residue was not, however, addressed by Kidd.

U.S. Pat. No. 608,051, to Kitson discloses a vapor-burning apparatus, consisting in part of a heat reflector that is said to concentrate heat both radiated and convective upon a U-shaped fuel generator. The orifice clogging due to undesired residue is not addressed. Indeed, details and diagrams for manually cleaning impurities from the fuel generator are included illustrating that from the very beginning of gasoline powered lanterns there has been an unresolved fuel generator orifice clogging problem.

Various other approaches have been taken to increase the efficiency of lanterns by the addition of a heat conducting device. Such heat conducting devices are disclosed in, for example, U.S. Pat. No. 930,020, to Arneson; U.S. Pat. No. 676,522, to Woillard; U.S. Pat. No. 976,127, to Harding; U.S. Pat. No. 1,042,863, to Wiltermood; U.S. Pat. No. 1,678,828, to Schultz; and U.S. Pat. No. 1,340,424, to Stafford. In the above lanterns the primary means to increase efficiency in a lantern is to pre-heat the fuel before the fuel reaches the mantel. Clogging of the orifice was not addressed.

U.S. Pat. No. 1,910,163, to Hogan discloses not only a heat conducting device to increase the temperature of the fuel passing through the fuel generator but also a built in cleaning device. Presumably, this manual orifice cleaning device will be used on initially lighting the lantern by rotating a mechanical arm that would clear the orifice of residue due to unburned vapors. A similar type of cleaning device is disclosed in U.S. Pat. No. 2,263,659, to Tullis.

As indicated, lanterns in the past have not addressed and have not solved the fuel generator orifice clogging problem by non-manual or non-replacement means. Instead, the art has addressed the problem by using specially blended "white" gasoline that is intended to cause a minimum of clogging of the fuel generator orifice.

Applicant has discovered that by placing a fuel converter of suitable dimensions on the lantern generator adjacent the lower edge of the lantern mantles, the orifice clogging problem that has long plagued the art is reduced or eliminated. The present invention therefore allows one to burn normal unleaded automotive type gasoline without the attendant clogging, problems.

It is therefore the principal object of the present invention to provide a novel means to use regular unleaded gasoline in lanterns that normally require "white" gasoline.

The construction designed to carry out the invention will be hereinafter described, together with other features thereof.

The invention will be more readily understood from a reading of the following specification and by reference to the accompanying drawings forming a part thereof, wherein an example of the invention is shown:

DETAILED DESCRIPTION OF THE DRAWINGS

DETAILED DESCRIPTION OF THE PREFERRED EMBODIMENT

Figure 1:
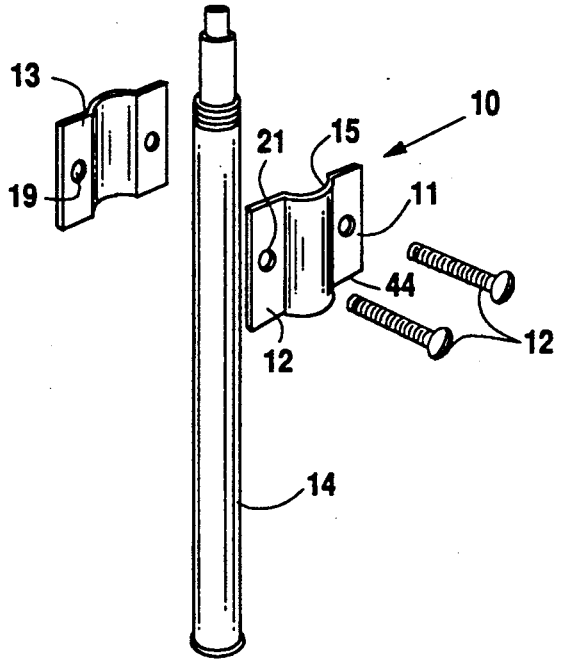
FIG. 1 is an illustration of a preferred embodiment of a fuel converter according to the present invention with an associated fuel generator.
Figure 2:
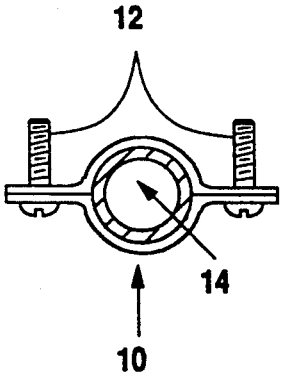
FIG. 2 is an elevated cross-sectional view of a fuel converter according to the present invention installed on a fuel generator.

Referring to FIG. 1, a preferred embodiment of the present invention is shown generally at 10. The fuel converter 10 consists of two substantially rectangular members 11, 13, preferably made from brass, each measuring approximately 1"×⅛"×¾, length, width and height, and approximately 0.050 inches in thickness. Each member has a concave portion 15 at its center extending along the vertical axis of the member, so as to mate with the outer periphery of a lantern generator 14. On either side of that concave portion 15 are laterally projecting flanges 17, 44. Those flanges on member 13 have threaded screw holes 19 to engage threaded bolts 12. Member 11 also has holes 21 to receive bolts 12. Each of the members 11, 13 of the heat exchanger is a mirror image of the other. Bolts 12, also preferable made from brass, are inserted into their respective holes and tightened to provide enough force to clamp members 11, 13 of the fuel converter 10 to the body of fuel generator 14. FIG. 2 illustrates the fuel converter 10 clamped to the fuel generator 14.

Figure 3:
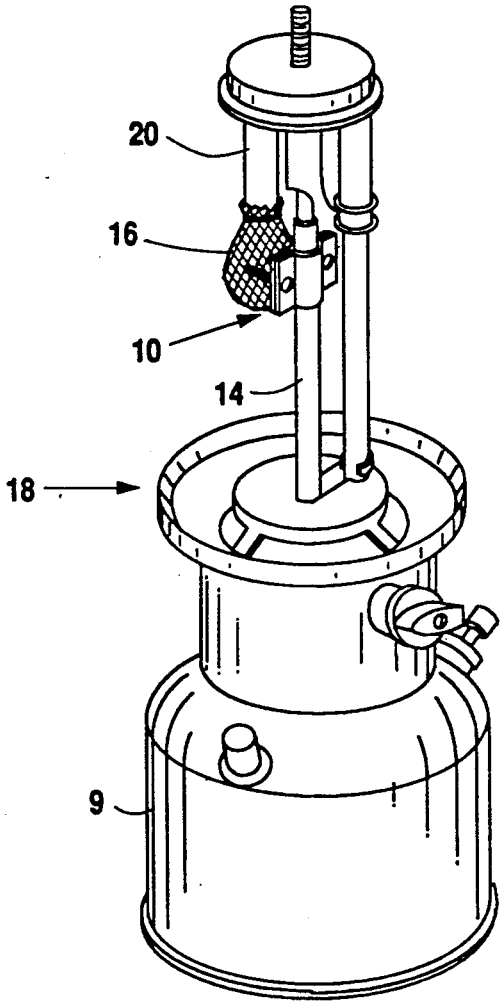
FIG. 3 is an illustration of a typical camping lantern with a fuel converter according to the present invention installed on a fuel generator.

Fuel converter 10 is placed over the fuel generator 14 and is preferably positioned so that the bottom portion thereof is in close proximity to the bottom portion of a mantel 16. FIG. 3 illustrates the placement of the fuel converter 10 of the present invention on a typical lantern 18.

The operation of the fuel converter 10 of the present invention is as follows: some of the heat produced by the mantel 16 is transferred to the fuel converter 10. In turn, the fuel converter 10 heats the fuel generator 14 in the area of the fuel converter 10 which raises the temperature of the gasoline and air mixture passing through the generator, and rapidly vaporizes the gasoline air mixture. The result is that the undesirable residues are vaporized before reaching the orifice of the generator.

Fuel converter 10 is of the appropriate size to transmit adequate heat to raise the temperature of the fuel to a highly vaporized state, but not to an overly vaporized state. The undesired residue is vaporized and does not collect in sufficient quantity to clog the orifice of generator 14.

Figure 4:
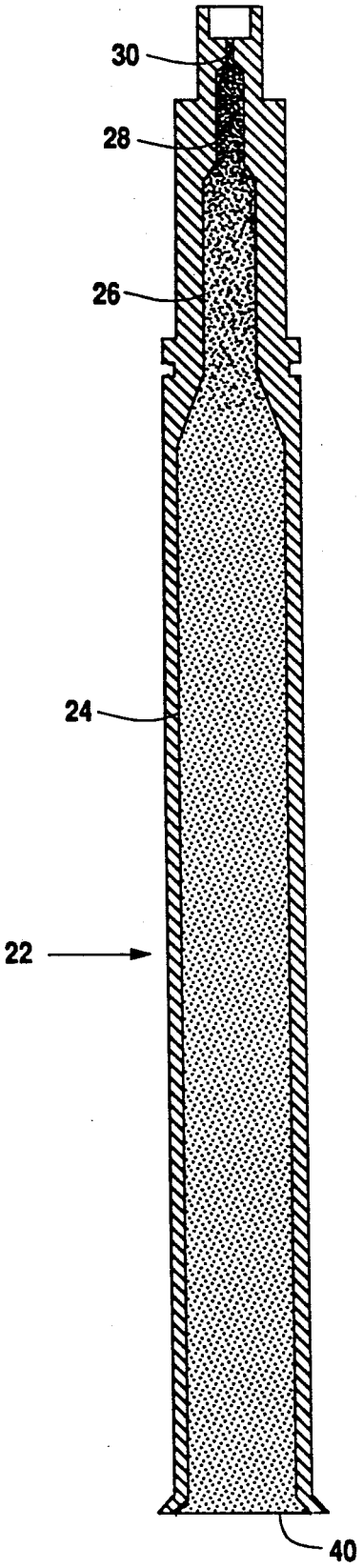
FIG. 4 is a photograph of a generator from a Coleman brand lantern that has burned normal unleaded fuel and illustrates the clogging problems.
Figure 5:
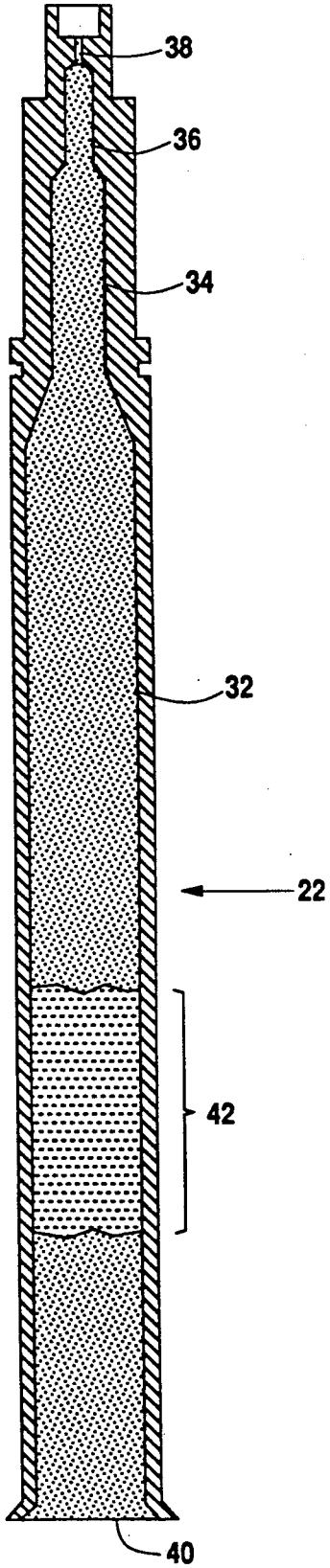
FIG. 5 is a photograph of a generator from a Coleman brand lantern that includes the fuel converter of the present invention and has burned normal unleaded fuel and illustrates the lack of clogging.

The operation of the present invention is dramatically illustrated on the photographs of FIGS. 4 and 5. FIG. 4 shows the inside of an actual Coleman brand fuel generator 22 that has been operated without the fuel converter of the present invention attached. FIG. 5 shows the inside of an actual Coleman brand fuel generator 22 that has been operated with the fuel converter of the present invention attached.

In FIG. 4, the generator was used in a standard Coleman brand Powerhouse lantern, such as illustrated in FIG. 3. Unleaded regular automotive gasoline, enters the fuel generator 22 at 40 from a reservoir or font 9 (FIG. 3). The fuel is under a pressure of approximately 15 pounds per square inch. The pressure is increased by decreasing the actual volume of the fuel generator 22. That is illustrated at 26. Orifice 30 is at the end of the fuel nozzle 28 of the generator. That orifice, by the virtue of its very small diameter, vaporizes the fuel. The fuel is then mixed with sufficient air in an expansion chamber 20 (FIG. 3) into a highly combustible state. Then the fuel and air mixture is burned in the mantel 16 (FIG. 3). The lantern using the generator shown in FIG. 4 was operated using normal automotive unleaded fuel for 5 days, 8 hours per day for a total of 40 hours. As can be clearly seen, the residue of the unvaporized gasoline 24 extends from the inlet 40 of the fuel generator 22 to the exit of the vaporized fuel at the orifice 30.

FIG. 5 illustrates a Coleman brand fuel generator that has been modified by the addition of a fuel converter according to the present invention located approximately at 42. The generator was operated in a standard Coleman brand Powerhouse lantern, such as shown in FIG. 3, and was the same type of lantern as that used with the generator of FIG. 4. Again, the fuel enters the generator 22 at 40 at approximately 15 psi. The pressure is increased by decreasing the actual volume of the fuel generator 22. This is illustrated by 34. The orifice 38 is at the end of the fuel nozzle 36. This orifice, by the virtue of its very small diameter will vaporize the fuel. The fuel is mixed with sufficient air to a highly combustible state. Then it is burned in the mantel 16 (FIG. 3). The lantern using the generator in FIG. 5 was also operated using the same normal unleaded fuel as the lantern using the generator in FIG. 4, and for 5 days at 8 hours per day for a total of 40 hours. The residue of the unvaporized gasoline 32 here, however, extends from the inlet 40 of the fuel generator 22 to approximately the beginning of the nozzle area 34. FIG. 5 clearly illustrates that with the addition of a fuel converter 10 of the present invention to the fuel generator 22, the nozzle 34 and the orifice 38 areas are cleaner than like areas of the generator in FIG. 4.

I claim:

1. In a gasoline fueled lantern having a base defining a fuel reservoir, pump means for producing a super ambient pressure in said reservoir, a tubular fuel generator extending upwardly from said fuel reservoir and having a nozzle therein for effecting vaporization of fuel forced upwardly thorough said generator, an expansion chamber communicating with said nozzle and a source of air, and mantles mounted in depending relation to said expansion chamber for effecting the burning of said mixture of gasoline vapor and air produced in said expansion chamber, the improvement comprising:

means for heating the vapor passing upwardly through said tubular fuel generator by the heat generated by said burning of gasoline vapor in said mantle;

said heating means comprising a pair of identical metallic plates each having a semi-cylindrical medial portion, whereby said plates are mountable on said tubular vaporizer with said semi-cylindrical portions disposed in surrounding relation thereto and the end portions of said plates being disposed in juxtaposed adjacent relation to said mantles to be heated thereby;

means for securing the end portions of said plates together to effect a clamping engagement of said semi-cylindrical portions against said tubular fuel generator;

thereby permitting the burning of non-leaded regular gasoline in said lantern with minimal deposits of residue in said nozzle.

* * * * *